US010934652B2

(12) United States Patent
Nishioka

(10) Patent No.: US 10,934,652 B2
(45) Date of Patent: Mar. 2, 2021

(54) WASHING MACHINE AND CONTROL METHOD THEREOF

(71) Applicant: Samsung Electronics Co., Ltd, Gyeonggi-do (KR)

(72) Inventor: Yoshiyuki Nishioka, Osaka (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 330 days.

(21) Appl. No.: 15/735,080

(22) PCT Filed: Jun. 11, 2015

(86) PCT No.: PCT/KR2015/005893
§ 371 (c)(1),
(2) Date: Dec. 8, 2017

(87) PCT Pub. No.: WO2016/199958
PCT Pub. Date: Dec. 15, 2018

(65) Prior Publication Data

US 2020/0032444 A1 Jan. 30, 2020

(30) Foreign Application Priority Data

Jun. 11, 2015 (KR) ..... KR10-2015-0082641

(51) Int. Cl.
*D06F 33/02* (2006.01)
*D06F 33/00* (2020.01)
(Continued)

(52) U.S. Cl.
CPC ..... *D06F 33/00* (2013.01); *D06F 37/24* (2013.01); *D06F 37/203* (2013.01);
(Continued)

(58) Field of Classification Search
CPC ..... D06F 33/02; D06F 37/24; D06F 37/203; D06F 39/028; D06F 39/087; D06F 2202/10
(Continued)

(56) References Cited

U.S. PATENT DOCUMENTS

2009/0293204 A1* 12/2009 Lee ..... D06F 35/006 8/159
2013/0290902 A1* 10/2013 Martin ..... D06F 39/005 715/823

FOREIGN PATENT DOCUMENTS

JP 2001104680 A 4/2001
JP 2013052061 A 3/2013
(Continued)

OTHER PUBLICATIONS

KR0168124B1—machine translation (Year: 1999).*
(Continued)

*Primary Examiner* — Tinsae B Ayalew

(57) ABSTRACT

The present disclosure is to deal with a case in which waterproof clothes, etc. are included in laundry. A washing machine 1 having a dehydration function may include a drum 20 rotatably accommodated in a tub 10, a water-level sensor 60 configured to detect a water level of water IW collected between the tub 10 and the drum 20, a circulation pump 80 configured to supply water to the inside of the drum 20 and to circulate water collected in the inside of the tub 10, and a control apparatus 70 configured to perform a dehydration process. The control apparatus 70 may include a dehydration course decider 74 configured to decide a dehydration course based on a change in water level of water IW collected between the tub 10 and the drum 20 by driving of the circulation pump 80.

9 Claims, 17 Drawing Sheets

(51) Int. Cl.

| | |
|---|---|
| ***D06F 37/24*** | (2006.01) |
| *D06F 37/20* | (2006.01) |
| *D06F 39/02* | (2006.01) |
| *D06F 39/08* | (2006.01) |

(52) U.S. Cl.
CPC ..... *D06F 39/028* (2013.01); *D06F 39/087* (2013.01); *D06F 2202/10* (2013.01)

(58) Field of Classification Search
USPC ..... 8/158
See application file for complete search history.

(56) References Cited

FOREIGN PATENT DOCUMENTS

| | | | | |
|---|---|---|---|---|
| JP | 2014083059 | A | * | 5/2014 |
| KR | 10-0168124 | B1 | | 4/1999 |
| KR | 10-2007-0009194 | A | | 1/2007 |
| KR | 10-2015-0047779 | A | | 5/2015 |

OTHER PUBLICATIONS

JP2014083059A—machine translation (Year: 2014).*
International Search Report dated Mar. 2, 2016 in connection with International Patent Application No. PCT/KR2015/005893.
Written Opinion of the International Searching Authority dated Mar. 2, 2016 in connection with International Patent Application No. PCT/KR2015/005893.

* cited by examiner

WASHING MACHINE AND CONTROL METHOD THEREOF

CROSS-REFERENCE TO RELATED APPLICATION(S)

The present application is a National Phase of International Patent Application No. PCT/KR2015/005893 filed Jun. 11, 2015, which claims priority to Korean Patent Application No. 10-2015-0082641 filed Jun. 11, 2015, which are incorporated herein by reference into the present disclosure as if fully set forth herein.

TECHNICAL FIELD

The present invention relates to a washing machine having a dehydration function, and more particularly, to a washing machine for appropriately controlling a dehydration process when waterproof clothes, etc. are included in laundry, and a method of controlling the washing machine.

BACKGROUND

In general, a washing machine (for example, a full automatic washing machine) includes an outer tub (hereinafter, referred to as a "tub") to store water (washing water or rinsing water), a washing drum (hereinafter, referred to as a "drum") combined with a dehydrating drum, rotatably installed in the inside of the tub to accommodate laundry, a pulsator rotatably installed in the inside of the drum to generate a water current, and a motor to generate a driving force for rotating the drum and the pulsator, to thereby remove contamination of laundry by a water current and an surfactant action of a detergent.

The washing machine performs washing by a series of operations including a washing course of separating contaminant from laundry with water (more specifically, washing water) in which a detergent is solved, a rinsing course of rinsing bubbles or the remaining detergent of the laundry with water (more specifically, rinsing water) in which no detergent is contained, and a dehydration course of removing water contained in the laundry through high-speed rotations.

The laundry to be washed by the series of operations may include waterproof clothes. Recently, according to development of various clothes, clothes made of waterproof fabrics are increasing, and accordingly, cases of washing such waterproof clothes are also increasing. Also, cases of washing waterproof sheets covering bedclothes, although the waterproof sheets are not washed by a washing machine, are increasing. That is, waterproof sheets are used to nurse the elderly, and according to an increase of the elderly, use of waterproof sheets is increasing. Since waterproof sheets are easy to be washed together with sheets, etc. covered thereon, cases of washing waterproof sheets by mistake are increasing. Such laundry is inclusively called "waterproof laundry".

A dehydration process is performed by discharging rinsing water collected in the tub, and rotating the drum to blow water contained in laundry by a centrifugal force. Accordingly, water-fast or waterproof laundry cannot be dehydrated, or it is not easy to dehydrate it. Also, since there is a case in which waterproof laundry prevents water from being discharged from the drum, it is inappropriate to dehydrate waterproof laundry.

That is, if a full automatic washing machine starts a dehydration process, a drum starts rotating to immediately discharge most of water in the inside of the drum so that laundry is gathered and fixed on the wall of the drum as the RPM increases. Accordingly, the drum rotates stably at high speed to perform an appropriate dehydration process. Although there are cases in which great vibrations or noise is generated due to an unbalance of a balance weight of clothes, no great trouble is caused since no water remains in the drum.

However, if waterproof laundry is included in the laundry, the waterproof laundry prevents water from being discharged, which may lead to a state in which dehydration is difficult due to water remaining in the drum, that is, a state of abnormal water remaining. If a dehydration process is performed in the state of abnormal water remaining, the rotating drum loses its balance due to swirling water, which may result in very great abnormal vibrations or noise. Particularly, since a large waterproof sheet is easy to collect a large amount of water, unexpected abnormal vibrations may be generated when such a waterproof sheet is included in laundry, which may lead to a great trouble such as a breakdown of the washing machine.

Accordingly, various studies for dealing with vibration problems that are generated during a dehydration process are being conducted.

For example, Patent Document 1 discloses a washing machine in which an acceleration sensor is installed in a tub accommodating a drum to detect abnormal vibrations from the detection values and stop rotating the drum. Also, Patent Document 2 discloses a washing machine for detecting abnormal vibrations from current waveforms input to a motor for driving a drum.

Patent Document 3 discloses a washing machine for measuring a time taken for a water level between a drum and a tub to change by a predetermined amount during drainage before a dehydration process, and comparing the time to a predetermined reference drainage time to thereby detect a state of abnormal water remaining and notify abnormality. Also, Patent Document 4 discloses a washing machine for measuring a dehydration rate or a moisture rate of laundry when a dehydration course starts, and comparing the measured value to a reference dehydration rate or a reference moisture rate to thereby detect a state of abnormal water remaining.

Patent Document 1: Japanese Laid-open Patent Application No. 2011-45618

Patent Document 2: Japanese Laid-open Patent Application No. 1996-252390

Patent Document 3: Japanese Laid-open Patent Application No. 2001-104680

Patent Document 4: Japanese Laid-open Patent Application No. 2014-64919

The washing machine disclosed in Patent Document 1 or Patent Document 2 cannot prevent abnormal vibrations in advance. Because of this, even in a state of abnormal water remaining, the drum continues to rotate until abnormal vibrations are generated and detected. Also, although abnormal vibrations are detected, the drum cannot stop immediately, which may lead to a trouble such as a breakdown of the washing machine.

Meanwhile, the washing machine disclosed in Patent Document 3 or Patent Document 4 can prevent abnormal vibrations in advance by detecting a state of abnormal water remaining before a dehydration process or when a dehydration process starts and informing the state of abnormal water remaining. However, the washing machine disclosed in Patent Document 3 or Patent Document 4 needs to be improved in term of the accuracy of detection.

For example, the washing machine disclosed in Patent Document 3 detects a state of abnormal water remaining according to a difference in drainage time, however, the washing machine has difficulties in detecting a state of abnormal water remaining due to a gradual change in water level since water is gradually discharged through a drain. Also, a case in which waterproof laundry is gathered and fixed on the wall of the drum in a state of abnormal water remaining is provided as an example, however, the case does not necessarily occur in a washing or rinsing course in which the drum rotates at low speed. Accordingly, conditions under which a state of abnormal water remaining can be appropriately detected are limited.

The washing machine disclosed in Patent Document 4 cannot perform detection of high accuracy since a dehydration rate or a moisture rate significantly depends on the kind or amount of laundry. Also, since the washing machine disclosed in Patent Document 4 needs to perform operation of rotating and stopping the drum several times to measure a dehydration rate or a moisture rate of laundry, it takes a long time to detect a state of abnormal water remaining, resulting in an increase of a time consumed for a dehydration course.

In order to overcome the above-described problems, an aspect of the present disclosure proposes a washing machine for appropriately controlling a dehydration process when waterproof clothes, etc. are included in laundry, and a method of controlling the washing machine.

SUMMARY

In accordance with an aspect of the present disclosure, there is provided a washing machine (a washing machine according to a first embodiment) including: a tub configured to accommodate water; a drum rotatably installed in the inside of the tub, and having a side wall to pass water through; a water-level sensor configured to detect a water level of water collected between the tub and the drum; a circulation pump configured to circulate water collected in the inside of the tub and to supply the water to the inside of the drum; and a control apparatus configured to control a dehydration course based on a change in water level detected by the water-level sensor according to driving of the circulation pump.

That is, the washing machine according to the first embodiment may include the circulation pump configured to supply water to the inside of the drum and to circulate water collected in the inside of the tub, and the control apparatus to perform a dehydration process may include a dehydration course decider configured to decide a dehydration course. The dehydration course decider may decide a dehydration course based on water collected between the tub and the drum by driving of the circulation pump, that is, a change of water collected between the tub and the drum.

When the circulation pump is driven, water may be discharged from the drum without resistance if no waterproof laundry is included in laundry, so that a water level of water collected between the tub and the drum little changes although the circulation pump is driven. However, if waterproof laundry is included in the laundry, the waterproof laundry may prevent water from being discharged from the drum so that a water level of water collected between the tub and the drum is greatly changed (reduced). Accordingly, the dehydration course decider may decide a dehydration course based on the change of the water to detect a state of abnormal water remaining with high accuracy. Therefore, it is possible to appropriately deal with a case in which waterproof clothes, etc. are included in laundry.

In accordance with another aspect of the present disclosure, there is provided a washing machine (a washing machine according to a second embodiment) including: a tub configured to accommodate water; a drum rotatably installed in the inside of the tub, and having a side wall to pass water through; a driving apparatus configured to rotate the drum; a water-level sensor configured to detect a water level of water collected between the tub and the drum; and a control apparatus configured to control a dehydration course based on a change in water level detected by the water-level sensor according to rotations of the drum in the state in which water is collected in the tub.

That is, in the washing machine according to the second embodiment, the drum may rotate in the state in which water is collected in the tub, although no circulation pump is provided, and the dehydration course decider may decide a dehydration course based on a change in water level between the tub and the drum generated at that time.

When the drum rotates, water in the inside of the drum may be discharged from the drum without resistance by an action of a centrifugal force if no waterproof laundry is included in laundry, so that a water level of water collected between the tub and the drum changes (increases) greatly. However, if waterproof laundry is included in the laundry, the waterproof laundry may prevent water from being discharged from the drum so that a water level of water collected between the tub and the drum little changes. Accordingly, the dehydration course decider may decide a dehydration course based on the change of the water to thereby detect a state of abnormal water remaining with high accuracy. Therefore, it is possible to appropriately deal with a case in which waterproof clothes, etc. are included in laundry.

In accordance with another aspect of the present disclosure, there is provided a washing machine (a washing machine according to a third embodiment) including: a tub configured to accommodate water; a drum rotatably installed in the inside of the tub, and having a side wall to pass water through; a driving apparatus configured to rotate the drum; a water-level sensor configured to detect a water level of water collected between the tub and the drum; a circulation pump configured to circulate water collected in the inside of the tub and to supply the water to the inside of the drum; and a control apparatus configured to control a first dehydration course based on a change in water level detected by the water-level sensor according to driving of the circulation pump, and to control a second dehydration course based on a change in water level detected by the water-level sensor according to rotations of the drum in the state in which water is collected in the tub.

The washing machine according to the third embodiment may include a first dehydration course decider corresponding to the dehydration course decider of the washing machine according to the first embodiment, and a second dehydration course decider corresponding to the dehydration course decider of the washing machine according to the second embodiment. The dehydration course deciders may decide a dehydration course based on changes in water level of water collected between the tub and the drum, thereby greatly improving the accuracy of detection, and more appropriately dealing with a case in which waterproof laundry is included in laundry.

In the washing machine according to the first embodiment or the third embodiment, the drum may include a stirring apparatus for stirring water collected in the inside of the drum, and when the stirring apparatus stops, the control apparatus may drive the circulation pump to detect a change in water level of water collected between the tub and the drum through the water-level sensor.

Thereby, since a change in water level can be detected without any influence by stirring of water, a change in water level can be measured with high accuracy.

Also, in the washing machine according to the first embodiment or the third embodiment, the drum may include a stirring apparatus for stirring water collected in the inside of the drum, and when the stirring apparatus operates, the control apparatus may drive the circulation pump to detect a change in water level of water collected between the tub and the drum through the water-level sensor.

Thereby, since it is possible to detect a change in water level without waiting until a rinsing process terminates, a time required for performing the entire processes can be reduced.

The washing machines may compare a change in water level of water collected between the tub and the drum to a predetermined reference value, and perform a low-speed dehydration course of limiting a dehydration RPM based on the result of the comparison to perform the dehydration course.

Thereby, it is possible to determine whether waterproof laundry is included in laundry, with high accuracy, through the comparison with the reference value, thereby performing a dehydration course without causing any great trouble.

Also, the washing machines may compare a change in water level of water collected between the tub and the drum to a predetermined reference value, and perform a high-speed dehydration course of performing the dehydration course without limiting a dehydration RPM based on the result of the comparison.

Thereby, it is possible to determine whether waterproof laundry is included in laundry, with high accuracy, through the comparison with the reference value, thereby performing a high-efficiency dehydration course for a short time.

Also, the washing machines may compare a change in water level of water collected between the tub and the drum to a predetermined reference value, and provide a notification to a user based on the result of the comparison.

Thereby, it is possible to induce a user to pay careful attention for the user's appropriate handling, resulting in an increase of convenience.

According to the proposed washing machine and the control method thereof, the water-level sensor may detect a water level changing according to driving of the circulation pump or rotations of the drum to determine whether waterproof clothes are included in laundry, and if waterproof clothes are included in the laundry, a dehydration process can be appropriately controlled.

DETAILED DESCRIPTION OF THE DRAWINGS

DETAILED DESCRIPTION

Hereinafter, embodiments of the present disclosure will be described with reference to the accompanying drawings.

Figure 1:
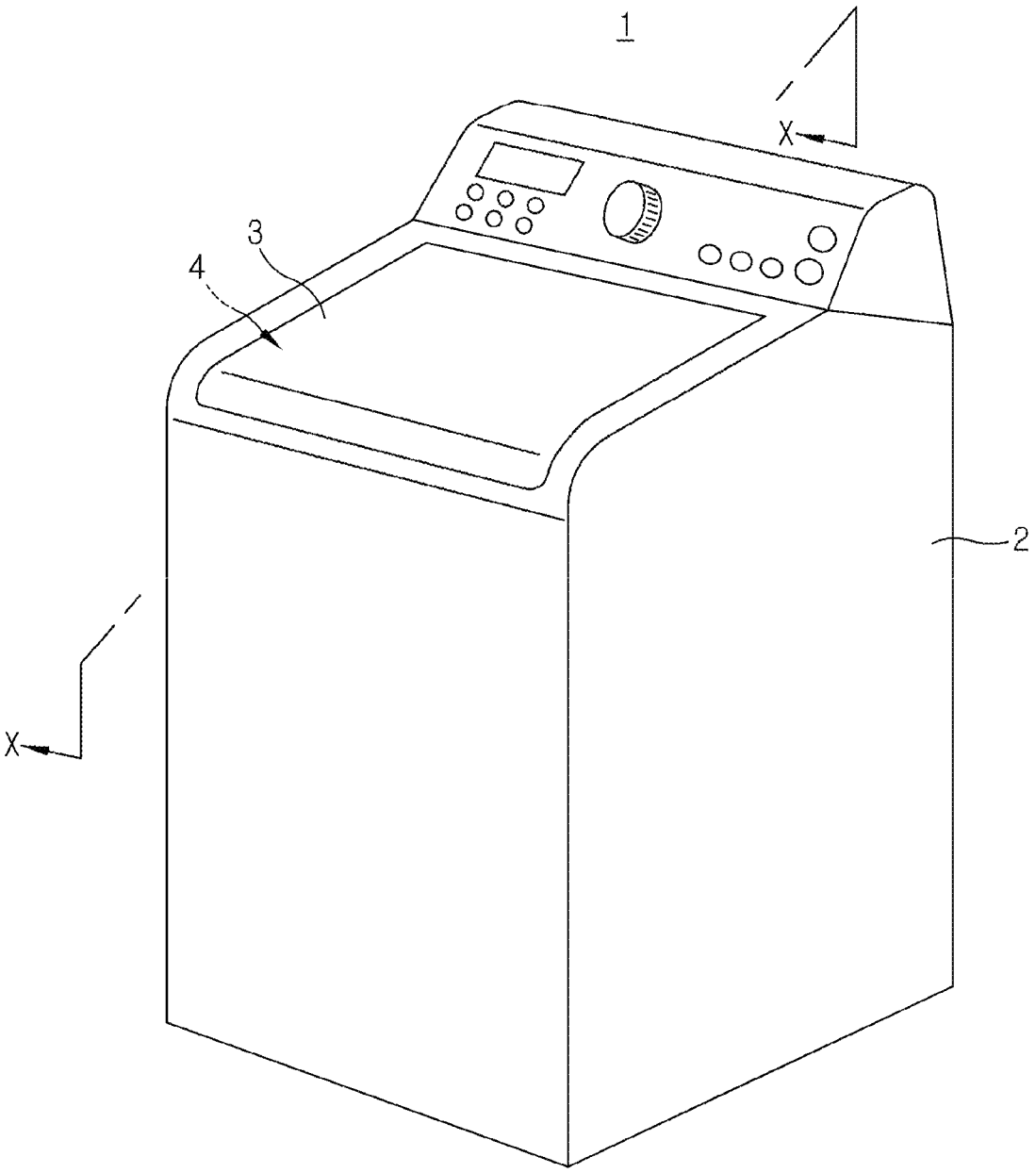
FIG. 1 is a schematic perspective view showing a washing machine according to an embodiment of the present disclosure.
Figure 2:
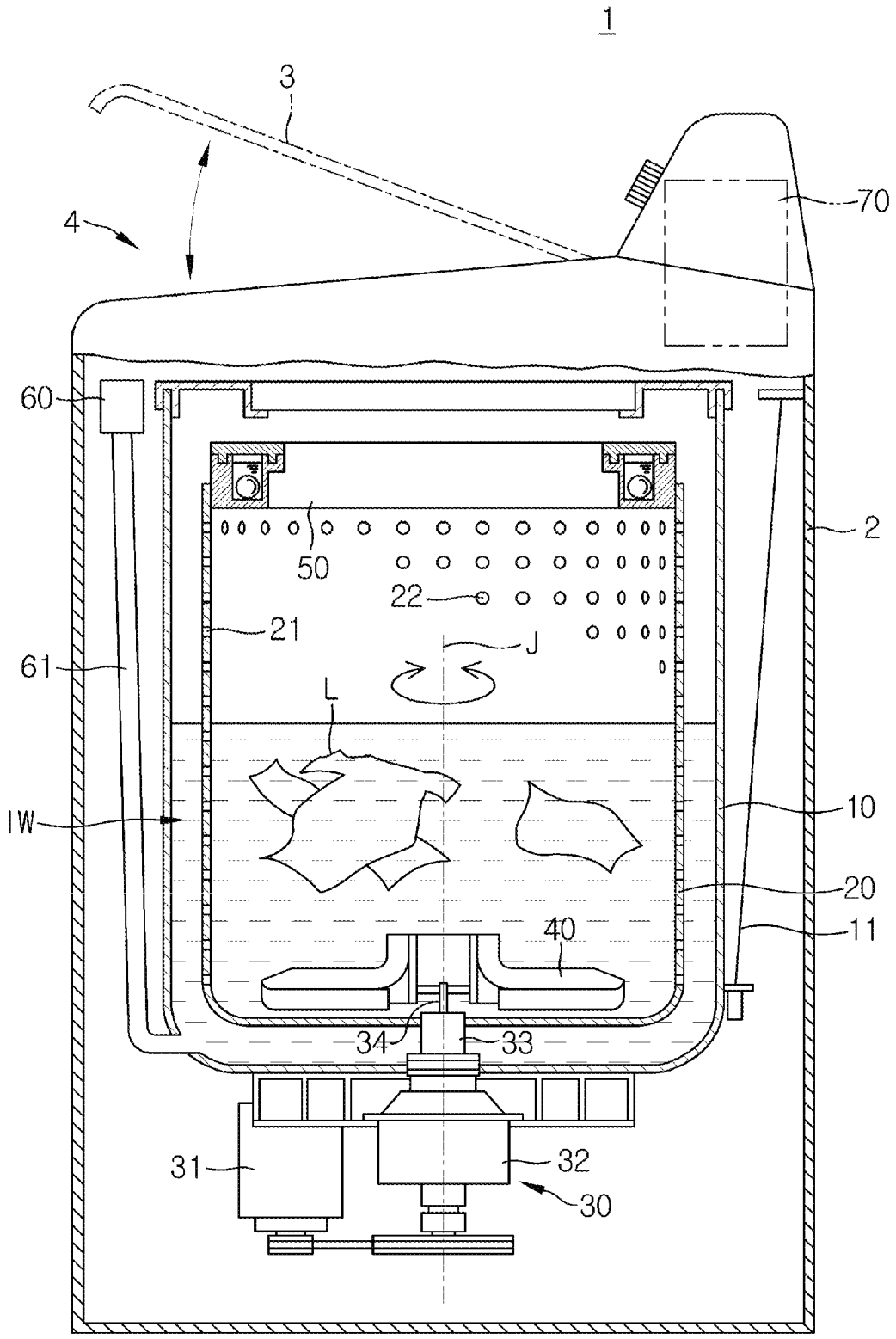
FIG. 2 is a schematic cross-sectional view taken along a line X-X of FIG. 1.

FIG. 1 is a schematic perspective view showing a washing machine according to an embodiment of the present disclosure, and FIG. 2 is a schematic cross-sectional view taken along a line X-X of FIG. 1.

In FIGS. 1 and 2, a washing machine 1 according to an embodiment of the present disclosure may be a full automatic washing machine that can automatically control and perform washing, rinsing, and dehydrating. The washing machine 1 may have a case 2 in the shape of a rounded box that is vertically long, and in the upper portion of the case 2, an opening 4 may be formed to be opened or closed by a door 3. Laundry L may be put or take out through the opening 4. That is, the washing machine 1 may be a vertical type washing machine having a vertical axis. Behind the opening 4, various switches or displays may be installed to enable a user to manipulate the washing machine 1.

Also, in the following description of the present disclosure, laundry L made of water-fast or waterproof fabrics, such as a rain coat, a diving suit, a waterproof sheet, and the like, will be referred to as waterproof laundry L2, and laundry L made of water-permeating fabrics, such as a shirt, a towel, and the like, will be referred to as water-permeating laundry L1.

In the inside of the case 2, a tub 10, a drum 20, a driving apparatus 30, a pulsator 40, a balancer 50, a water-level sensor 60, and a control apparatus 70 may be installed.

The tub 10 may be a cylindrical container having a bottom, and may be suspended on the inner wall of the case 2 by a plurality of dampers 11 such that an opening of the tub 10 opens towards the opening 4. Water supplied by a water-supply apparatus (not shown) may be stored in the inside of the tub 10, and water stored in the tub 10 may be discharged to the outside of the washing machine 1 through a drain apparatus (not shown).

The drum 20 may be a cylindrical container having a significantly smaller size than the tub 10 and having a bottom to accommodate laundry L. The drum 20 may be accommodated in the tub 10 in such a way to be rotatable with respect to a vertical axis J extending vertically towards the opening 4. In the inside of the drum 20, laundry L may be washed, rinsed, and dehydrated. In an entire side wall of the drum 20 in the shape of a cylinder, a plurality of dehydrating holes 22 may be formed to pass water through without resistance (in FIG. 2, some of the plurality of dehydrating holes 22 are shown).

In a lower portion of the drum 20, the pulsator 40 (stirring apparatus) having stirring blades may be installed in the shape of a circular disk to be rotatable.

The balancer 50 may be a ring-shaped member that accommodates a plurality of balls or a viscous fluid therein. The balancer 50 may be installed in the opening of the drum 20 to adjust an unbalance of a balance weight caused by cornered laundry L when the drum 20 rotates.

The water-level sensor 60 may be disposed in an upper end portion of a water-level detecting pipe 61 extending upward from a lower portion of the tub 10. Since an upper end of the water-level detecting pipe 61 is encapsulated and a lower end of the water-level detecting pipe 61 communicates with the inside of the tub 10, water may enter or leave the water-level detecting pipe 61 according to rising or falling of a water level in the tub 10 so that internal pressure of the water-level detecting pipe 61 may change. The water-level sensor 60 may detect a water level of water collected in the tub 10, more specifically, water IW collected between the tub 10 and the drum 20, according to a change of the internal pressure.

The driving apparatus 30 may be configured with a motor 31, a power transfer apparatus 32, etc., and installed on an outer surface of the bottom of the tub 10. The power transfer apparatus 32 may have a first shaft 33 and a second shaft 34 protruding to the inside of the tub 10. The first shaft 33 may be installed at the drum 20, and the second shaft 34 may further protrude to the inside of the drum 20 to be installed at the pulsator 40.

The driving apparatus 30 may drive the motor 31 to rotate the tub 10 and the drum 20 forward or backward through the first shaft 33 and the second shaft 34. For example, in a washing or rinsing process, the driving apparatus 30 may rotate the pulsator 40 while reversing the pulsator 40 at regular time periods to thereby stir laundry L together with water or a detergent. In a dehydration process, the driving apparatus 30 may rotate the drum 20 at high speed in a predetermined direction to make laundry L gathered on the side wall 21, so that water collected in the inside of the drum 20 or water included in the laundry L can be discharged from the drum 20 through the dehydrating holes 22 by a centrifugal force.

Figure 3:
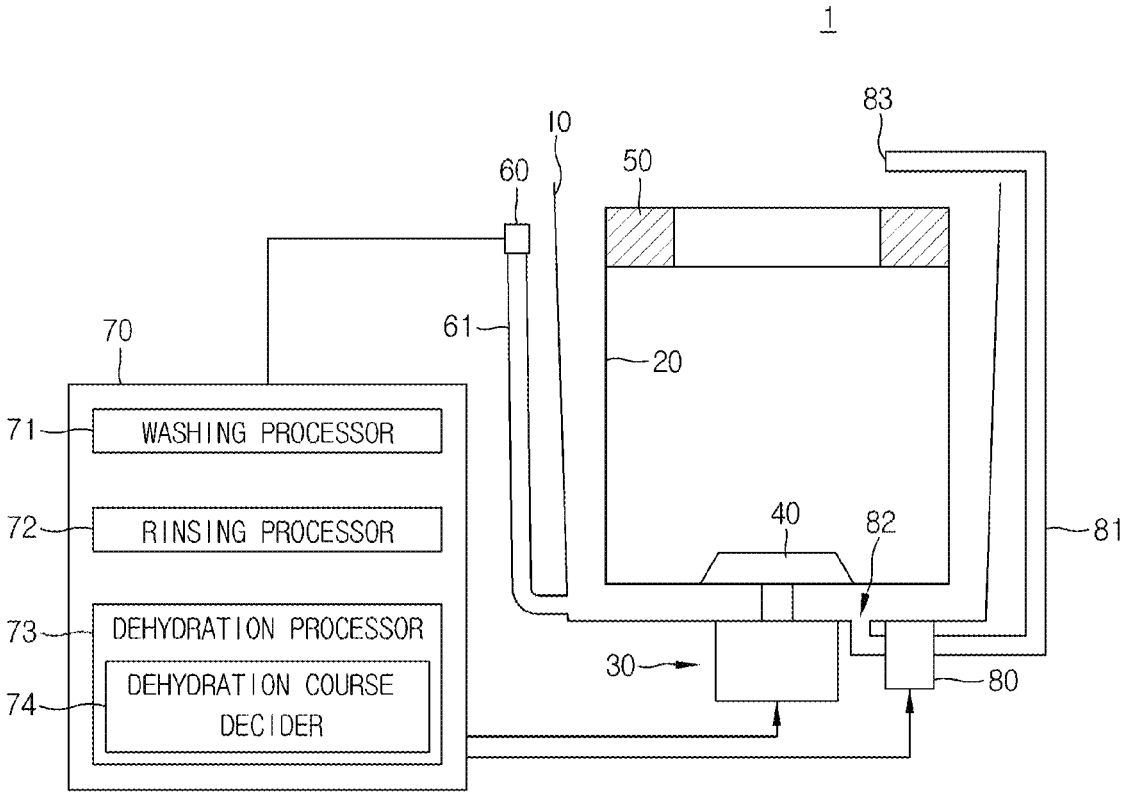
FIG. 3 is a view briefly showing a main portion of the washing machine shown in FIG. 1.

FIG. 3 is a view briefly showing a main portion of the washing machine shown in FIG. 1.

As shown in FIG. 3, the washing machine 1 according to the embodiment of the present disclosure may include a circulation pump 80. The circulation pump 80 may be installed on the outer surface of the bottom of the tub 10 to be adjacent to the driving apparatus 30. The circulation pump 80 may be installed in a part of a circulation water pipe 81 extending toward the inside of the drum 20 and having an inlet 82 opening to the inside of the tub 10 at one end and a water-supply opening 82 at the other end. If the circulation pump 80 is driven, water may be sucked into the inlet 82, and the water may be discharged from the water-supply opening 83 to the inside of the drum 20 so that water collected in the inside of the tub 10 can be circulated.

The control apparatus 70 may be configured with hardware, such as a Central Processing Unit (CPU) or Read Only Memory (ROM), and software such as control programs, to control overall processes that are performed by the washing machine 1. The control apparatus 70 may be electrically connected to the driving apparatus 30, the water-level sensor 60, and the circulation pump 80, and control the driving apparatus 30, the water-level sensor 60, and the circulation pump 80 according to a user's instruction to perform washing, rinsing, and dehydration processes.

In the control apparatus 70, a washing processor 71 to control all courses of a washing process, a rinsing processor 72 to control all courses of a rinsing process, and a dehydration processor 73 to control all courses of a dehydration process may be installed. Particularly, the dehydration processor 73 may include a dehydration course decider 74 to appropriately deal with a case in which waterproof laundry L2 is included in laundry L.

(Operation of the Washing Machine)

Hereinafter, operations of the washing machine 1 will be described with reference to FIG. 4.

Figure 4:
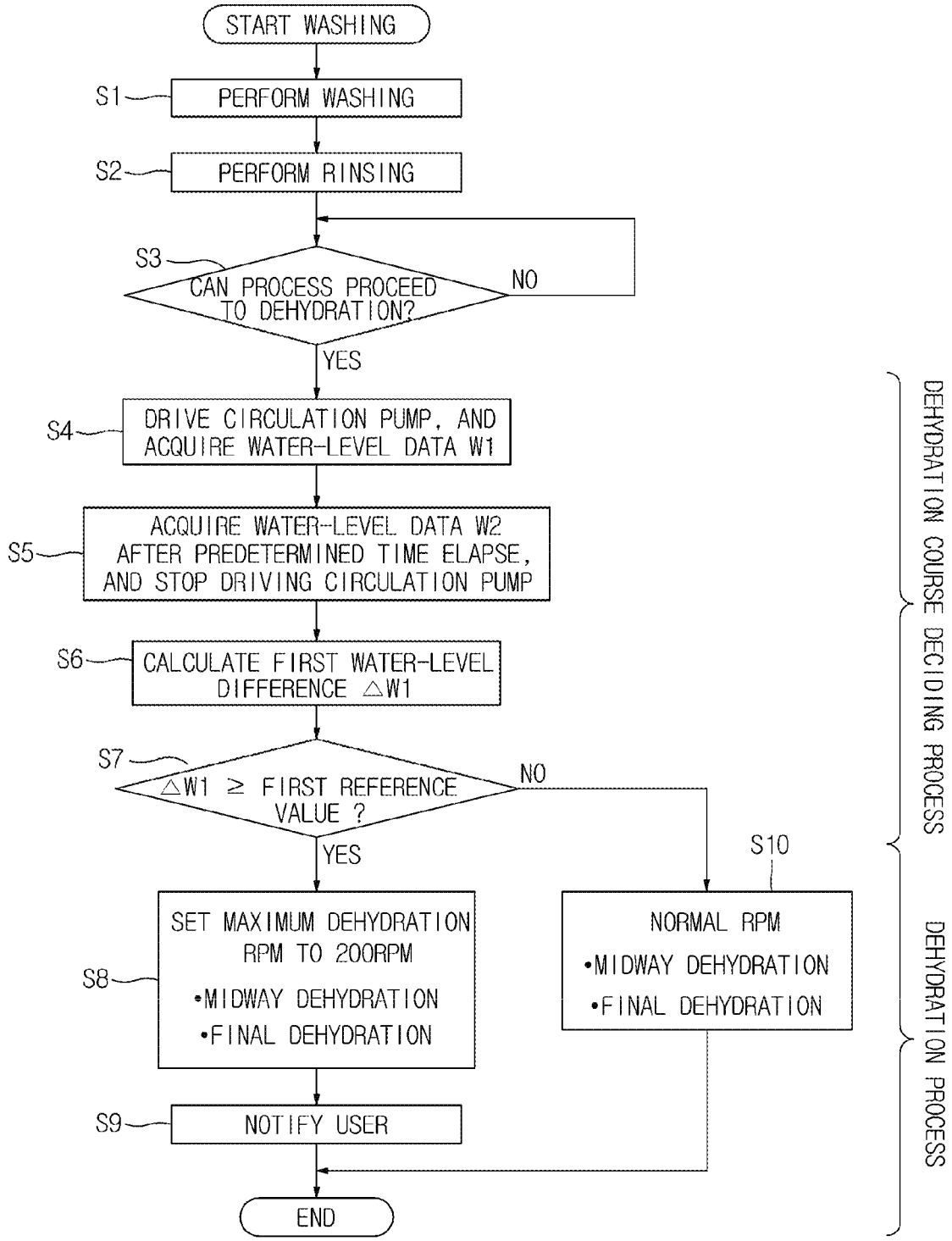
FIG. 4 is a flowchart illustrating the operation of the washing machine according to the first embodiment of the present disclosure.

In FIG. 4, a user may put laundry L and a detergent in the opening 4, and manipulate a switch to perform a full automatic process. Thereby, the washing machine 1 may operate to start a series of processes of washing, rinsing, and dehydration.

Then, a predetermined amount of water may be supplied by the washing processor 71, and then the driving apparatus 30 may rotate the pulsator 40 for a predetermined time period to perform a washing process, in operation S1.

Thereafter, water may be changed by the rinsing processor 72, and simultaneously, the driving apparatus 30 may rotate the pulsator 40 for a predetermined time period to perform a rinsing process, in operation S2. During the rinsing process, the circulation pump 80 may operate for a predetermined time period to circulate water in the inside of the tub 10.

Successively, the rinsing processor 72 may determine whether the process can proceed to a dehydration process, in operation S3, and perform the rinsing process until the process can proceed to a dehydration process.

If the rinsing process terminates so that a dehydration process can be performed, the pulsator 40 may rotate smoothly forward in the state in which water is collected in the tub 10 to perform a tangling prevention process of untangling laundry L to reduce an unbalance of the laundry L.

Then, a dehydration course deciding process for deciding a dehydration course may be performed simultaneously with the tangling prevention process ("YES" in operation S3).

Also, the dehydration course deciding process may be performed separately from the tangling prevention process.

However, if the dehydration course deciding process is performed simultaneously with the tangling prevention process, an unbalance of the laundry L in the inside of the drum 20 can be reduced, resulting in a more correct detection.

The dehydration course deciding process may be a process of detecting a state (abnormal water remaining) in which dehydration is difficult due to water remaining in the inside of the drum 20 by the influence of waterproof laundry L2, and deciding a dehydration course according to the result of the detection. The dehydration course deciding process may be performed by the dehydration course decider 74.

More specifically, the circulation pump 80 may be driven, and the water-level sensor 60 may measure reference water-level data (W1: first water level) just after the circulation pump 80 starts being driven, in operation S4.

Then, when a predetermined time period (for example, 1 minute) elapses after the circulation pump 80 starts being driven, the water-level sensor 60 may measure comparative water-level data (W2: second water level). If the measurement terminates, the circulation pump 80 or the pulsator 40 may stop, and water may be discharged to the outside of the washing machine 1, in operation S5.

The dehydration course decider 74 may calculate a first water-level difference ($\Delta W1=W2-W1$) using the first and second water-level data W1 and W2 received from the water-level sensor 60, in operation S6, and determine whether the first water-level difference ΔW1 is greater than or equal to a first reference value (for example, 60 mm), in operation S7.

The first reference value may be a threshold value for determining a state of abnormal water remaining, and may have been set in advance by the dehydration course decider 74. The first reference value may be set based on experience values or the results of a dehydration test according to the size or type of a washing machine. Also, the water-level data or the system of units of the first reference value may not need to be a length, and may be a current value or a frequency value corresponding to a water level.

The determination by the dehydration course decider 74 will be described in detail with reference to FIGS. 5 to 9, below.

Figure 5:
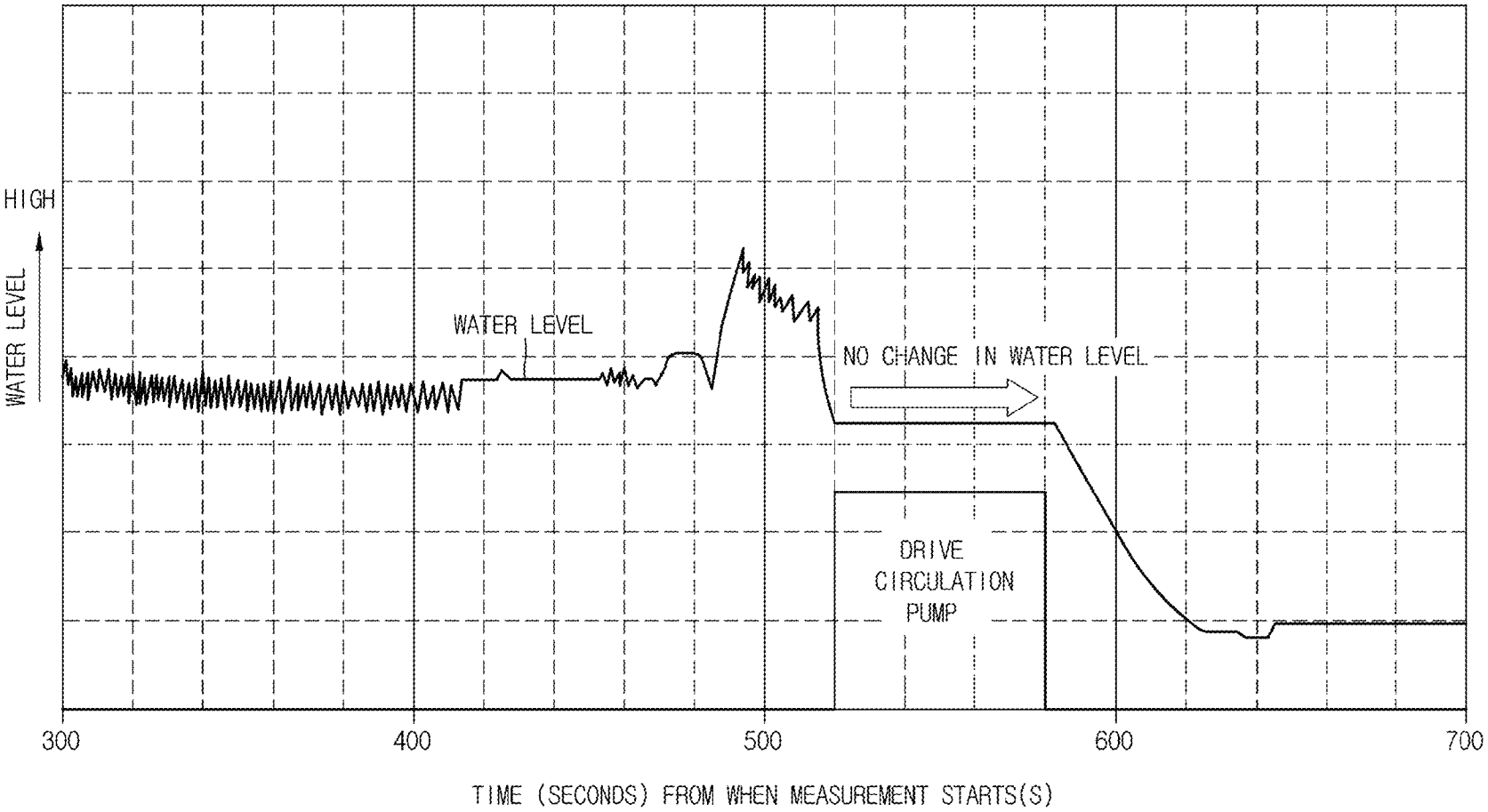
FIG. 5 shows an example of changes in water level of water between the tub and the drum before and after the circulation pump is driven in the case in which all laundry is water-permeating laundry.
Figure 6:
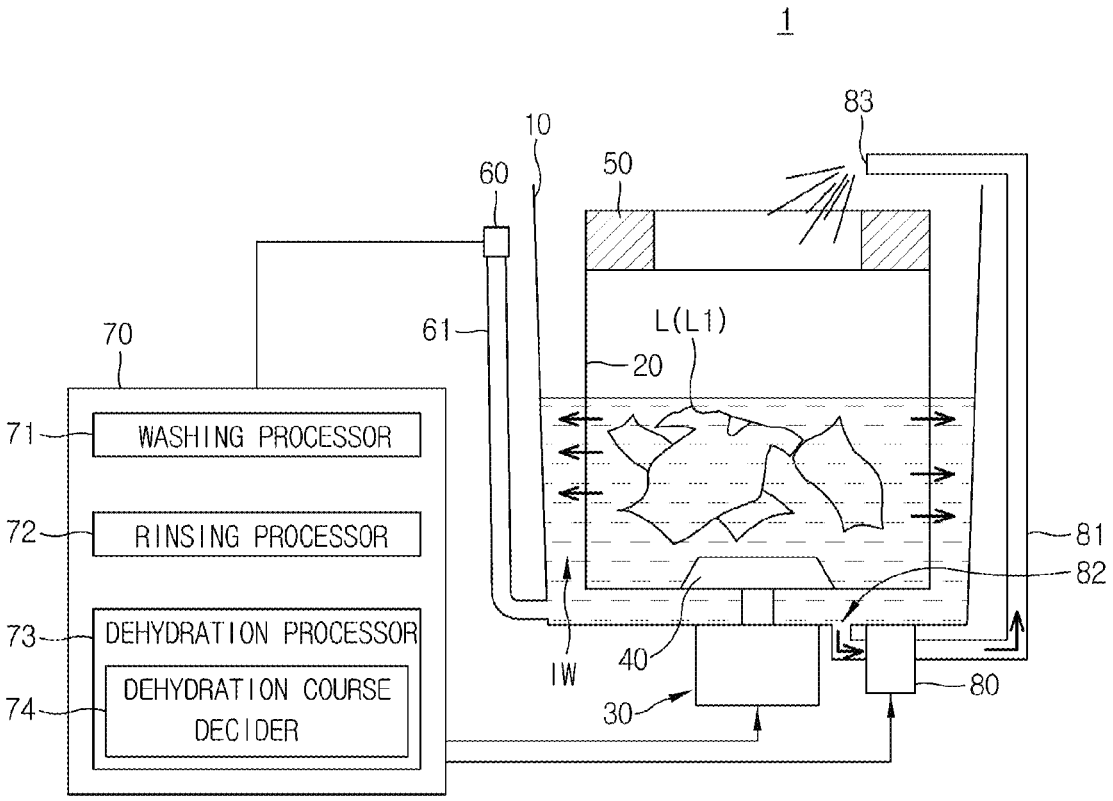
FIG. 6 is a view briefly showing a state when the circulation pump is driven in the case in which all laundry is water-permeating laundry.
Figure 7:
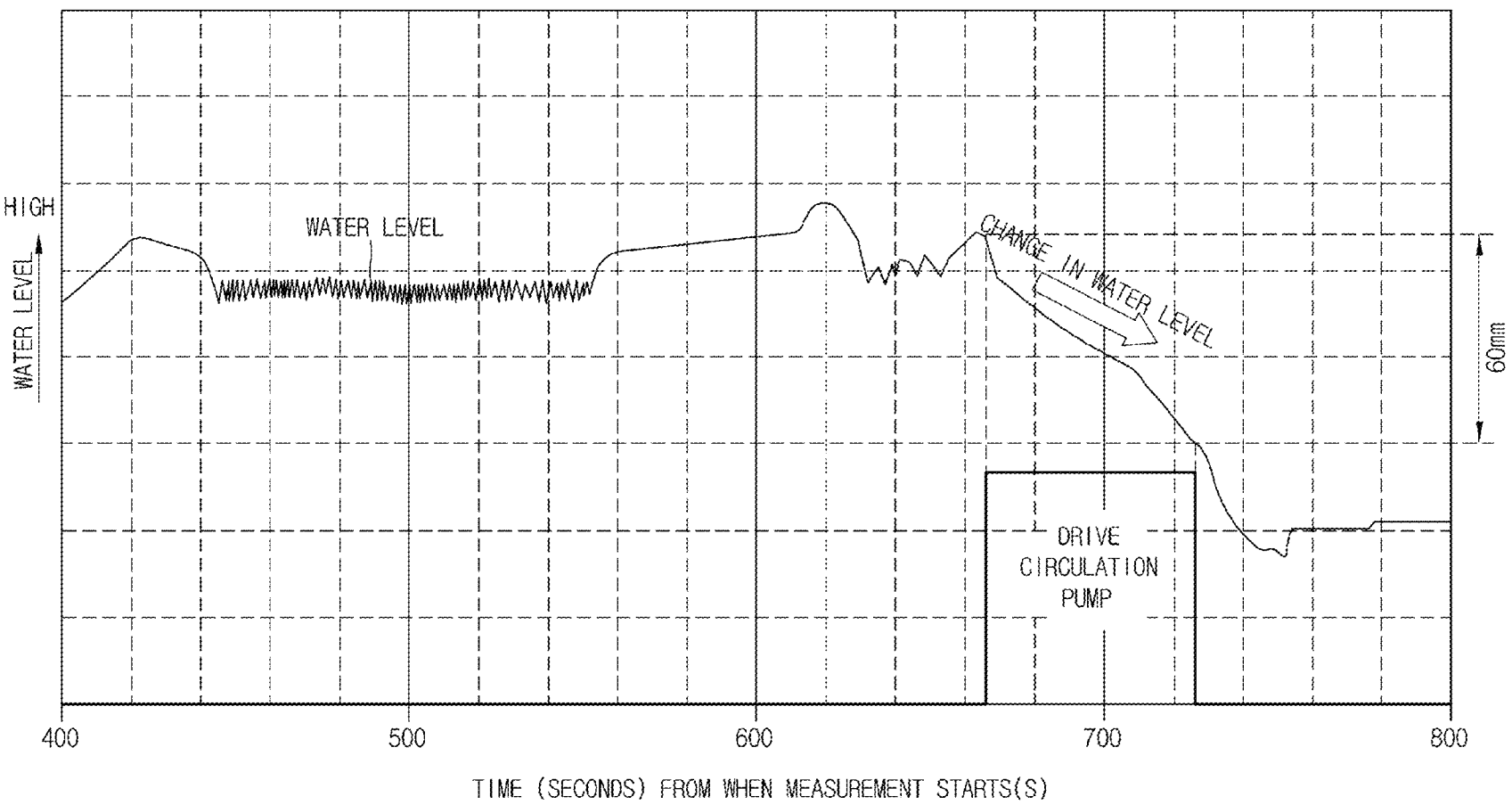
FIG. 7 shows an example of changes in water level of water between the tub and the drum before and after the circulation pump is driven in the case in which laundry includes waterproof laundry.
Figure 8:
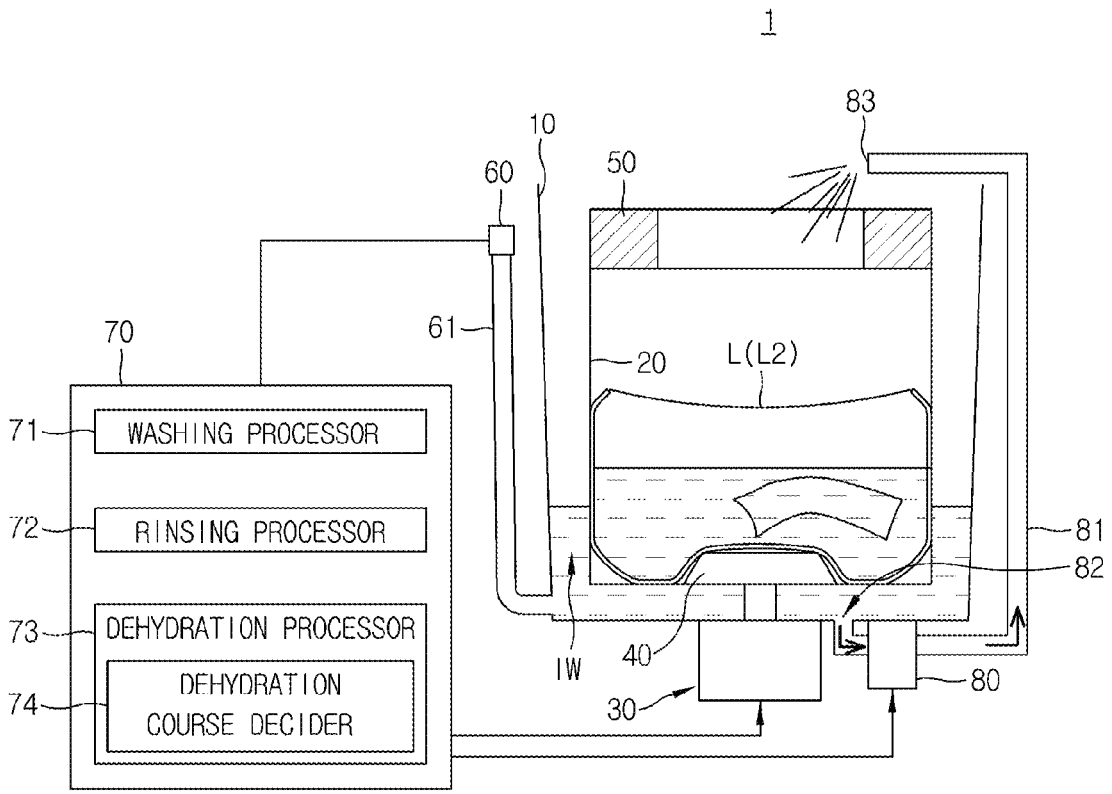
FIG. 8 is a view briefly showing a state when the circulation pump is driven in the case in which laundry includes waterproof laundry.
Figure 9:
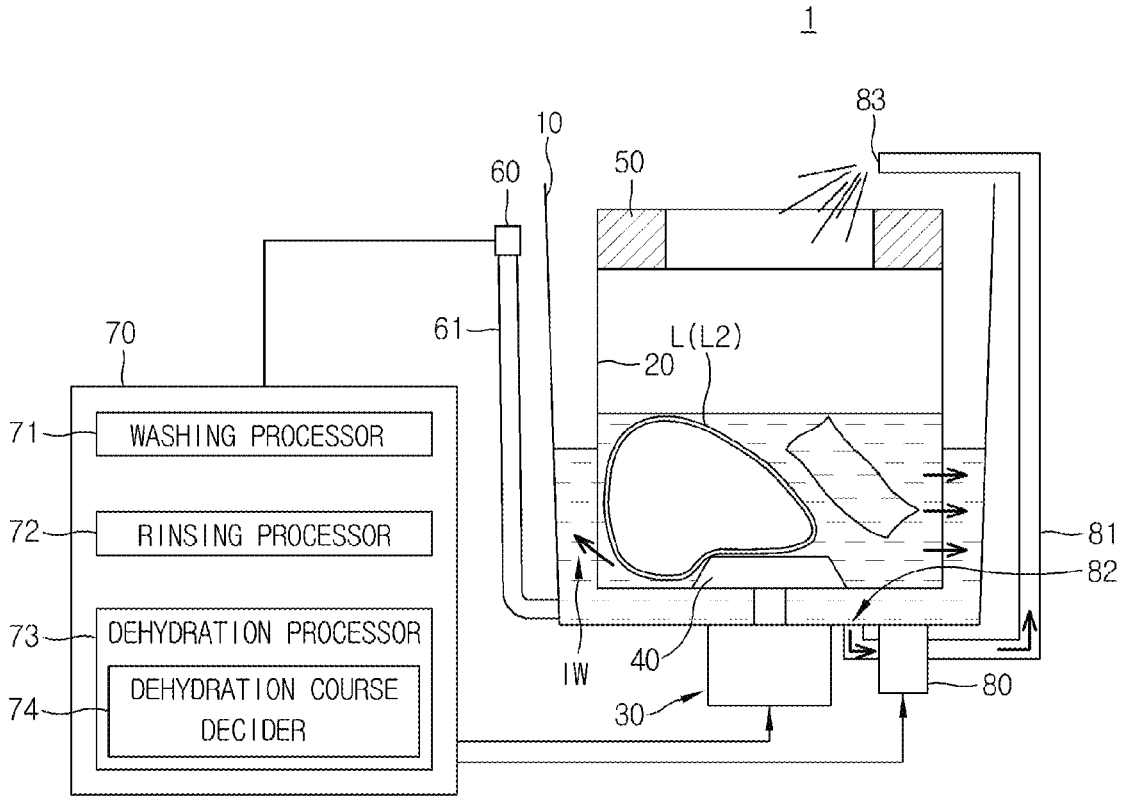
FIG. 9 is a view briefly showing a state when the circulation pump is driven in the case in which laundry includes waterproof laundry.

FIG. 5 shows an example of changes in water level of water between the tub and the drum before and after the circulation pump is driven in the case in which all laundry is water-permeating laundry, FIG. 6 is a view briefly showing a state when the circulation pump is driven in the case in which all laundry is water-permeating laundry, FIG. 7 shows an example of changes in water level of water between the tub and the drum before and after the circulation pump is driven in the case in which laundry includes waterproof laundry, FIG. 8 is a view briefly showing a state when the circulation pump is driven in the case in which laundry includes waterproof laundry, and FIG. 9 is a view briefly showing a state when the circulation pump is driven in the case in which laundry includes waterproof laundry.

FIG. 5 shows an example of changes in water level of water IW collected between the tub 10 and the drum 20 in the case in which all laundry L is water-permeating laundry L1. Water-level changes until about 40 seconds before the circulation pump 80 starts operating may be caused by the influence of a water current in a rinsing process, and water-level changes after that time may be caused by the influence of a tangling prevention process.

Referring to FIG. 6, if the circulation pump 80 is driven, water may be discharged through the bottom of the tub 10, and the water may be again supplied to the inside of the drum 20. However, if all laundry L is water-permeating laundry L1, water may be discharged from the drum 20 without resistance, so that a water level of water IW collected between the tub 10 and the drum 20 little changes, as denoted by a thick arrow in FIG. 5, although the circulation pump 80 is driven. Accordingly, in the case in which all laundry L is water-permeating laundry L1, a first water-level difference ΔW1 may become a very small value. Also, as shown in FIG. 5 (or FIG. 7), falling of a water level after the circulation pump 80 stops may be caused by a drainage process.

FIG. 7 shows an example of changes in water level of water IW collected between the tub 10 and the drum 20 in the case in which laundry L includes waterproof laundry L1. For example, as shown in FIG. 8, if waterproof laundry L2 is gathered on the wall of the drum 20, an amount of water discharged from the drum 20 may be reduced, and accordingly, a water level in the inside of the drum 20 may rise, whereas a water level of water IW collected between the tub 10 and the drum 20 may fall by suction of the circulation pump 80, as denoted by a thick arrow of FIG. 7. Accordingly, a first water-level difference ΔW1 may become a great value.

Also, as shown in FIG. 9, if waterproof laundry L2 is filled with water without being gathered on the wall of the drum 20, no detection can be performed by a method using a drainage time, like Patent Document 3 described above. In this case, since a water current towards the side wall is generated in the inside of the drum 20 due to circulation of water, the waterproof laundry L2 may be gathered on the side wall to prevent water from being discharged from the drum 20. Accordingly, in this case, a first water-level difference ΔW1 may become a great value.

As such, a first water-level difference ΔW1 measured when laundry L includes waterproof laundry L2 may be greater than a first water-level difference ΔW1 measured when all laundry L is water-permeating laundry L1. Accordingly, in the current example, the first reference value may be set to 60 mm to detect a state of abnormal water remaining.

Also, times at which reference water-level data W1 and comparative water-level data W2 are measured are not limited to just after the circulation pump 80 starts being driven and when the circulation pump 80 is driven. For example, reference water-level data W1 may be measured before or after the circulation pump 80 is driven, and comparative water-level data W2 may be measured after the circulation pump 80 stops. It is important to measure first water-level data W1 and second water-level data W2 at times before and after at least one part of a time period for which the circulation pump 80 is driven. Also, water-level data may be measured three times or more, and a state of abnormal water remaining may be detected based on the measured data.

During a rinsing process for which the pulsator 40 operates, the circulation pump 80 may be driven to measure reference water-level data and/or comparative water-level data. In this case, a water level may change by the influence of a water current. However, since a dehydration process can be performed immediately after the rinsing process terminates, a total time required for performing the entire processes can be reduced.

If the dehydration course decider 74 determines that the first water-level difference ΔW1 is greater than or equal to the first reference value, a low-speed dehydration process may be selected to limit the RPM of the drum 20, so that a dehydration process of midway dehydration or final dehydration may be performed, in operation S8. More specifically, the RPM of the drum 20 may be limited to 200 rpm or lower, and then a dehydration process may be performed. By limiting the RPM of the drum 20 to 200 rpm or lower, it is possible to perform a dehydration process without generating unexpected abnormal vibrations.

Technicians skilled in the related art have conducted tests related to a dehydration process in a state of abnormal water remaining under various conditions. According to the results of the tests, cases in which abrupt abnormal vibrations are generated by an amount of remaining water or in the state of abnormal water remaining occurred intensively at 600 rpm or higher, and at 400 rpm or lower, no abnormal vibrations were detected although a large amount of water of 10 L or more remains in consideration of waterproof sheets.

Accordingly, by limiting the RPM of the drum 20 to 200 rpm which is half 400 rpm to perform a dehydration process, it is possible to perform the dehydration process without generating unexpected abnormal vibrations causing a trouble even in a state of abnormal water remaining.

After the dehydration process is completed, a notification message for requiring a user's attention, such as a message for informing a low dehydration effect or a message for informing that waterproof laundry L2 is included, may be sent through a buzzer, voice, a display, etc., in operation S9. However, the notification message may be sent before the dehydration process is performed, not after the dehydration process is completed. If the notification message is sent before the dehydration process is performed, the user can stop the dehydration process or perform the dehydration process after taking out the waterproof laundry L2.

Meanwhile, if the dehydration course decider 74 determines that the first water-level difference ΔW is smaller than the first reference value, a high-speed dehydration course may be selected so that a midway dehydration process or a final dehydration process may be performed at generally 200 rpm or higher since the RPM of the drum 20 is not limited, in operation S10. That is, since no state of abnormal water remaining is detected, the drum 20 may rotate at high speed of 500 rpm or higher so that a dehydration process is performed in an optimal condition. Accordingly, a high-efficiency dehydration process can be performed for a short time.

Also, since the washing machine disclosed in Patent Document 1 or Patent Document 2 described above detects an unbalance after the unbalance occurs, the washing machine cannot perform dehydration control of selecting the RPM of the drum 20. Also, since the washing machine disclosed in Patent Document 3 or Patent Document 4 has low accuracy of detection in a state of abnormal water remaining, a case of selecting an inappropriate course may often occur so that an appropriate dehydration process cannot be performed.

Second Embodiment (Configuration of the Washing Machine)

A configuration of a washing machine 1 according to a second embodiment of the present disclosure may be the same as that of the washing machine 1 according to the first embodiment shown in FIGS. 1 and 2, except that neither the circulation pump 80 nor the circulation water pipe 81 are installed. Accordingly, the same components as those of the washing machine 1 according to the first embodiment will be assigned the same reference numerals including the reference numeral 1 representing the washing machine, and detailed descriptions thereof will be omitted.

The washing machine 1 may decide a dehydration course, based on changes in water-level of water IW collected between the tub 10 and the drum 20 when the drum 20 rotates in the state in which water is collected in the drum 20, instead of changes in water-level of water IW collected between the tub 10 and the drum 20 by the circulation pump 80. The operation of the washing machine 1 will be described with reference to FIG. 10, below.

(Operation of the Washing Machine)

Figure 10:
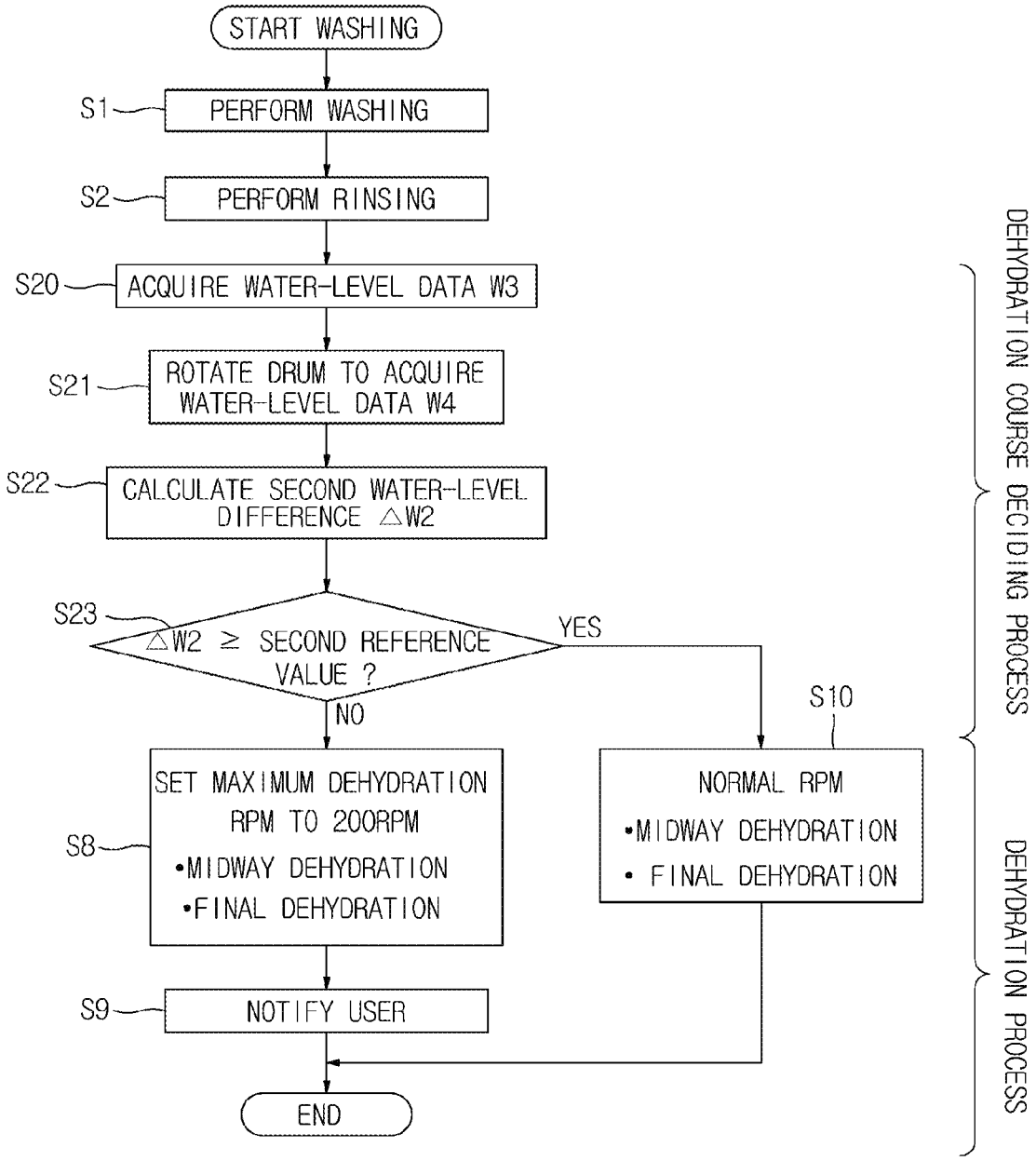
FIG. 10 is a flowchart illustrating the operation of the washing machine according to the second embodiment of the present disclosure.

FIG. 10 is a flowchart illustrating the operation of the washing machine according to the second embodiment of the present disclosure.

In FIG. 10, a washing process and a rinsing process may be the same as the corresponding ones of the first embodiment. That is, a user may put laundry L and a detergent, and manipulate a switch to operate the washing machine 1. Thereby, a washing process may be performed by the washing processor 71, in operation S1, and a rinsing process may be performed by the rinsing process 72, in operation S2.

Also, since the washing machine 1 has no circulation function, a process of circulating water in the inside of the tub 10 may be not performed.

After the rinsing process terminates, a tangling prevention process may be performed, and simultaneously, the dehydration course decider 74 may perform a dehydration course deciding process of detecting a state of abnormal water remaining to decide a dehydration course.

More specifically, the water-level sensor 60 may measure reference water-level data (W3: third water level), in operation S20.

Thereafter, the drum 20 may rotate at RPM (for example, 100 rpm) for water-level detection, which is lower than at least 200 rpm, and while the drum 20 rotates, the water-level sensor 60 may measure comparative water-level data (W4: a fourth water level), in operation S21. If the measurement terminates, the drum 20 or the pulsator 40 may stop rotating, and a drainage process may be performed.

The dehydration course decider 74 may calculate a second water-level difference (ΔW2=W3−W4) using the third and fourth water-level data W3 and W4 received from the water-level sensor 60, in operation S22, and determine whether the second water-level difference ΔW2 is greater than or equal to a second reference value (for example, 13 mm), in operation S23.

The determination of the dehydration course decider 74 will be described in detail with reference to FIGS. 11 to 15, below.

Figure 11:
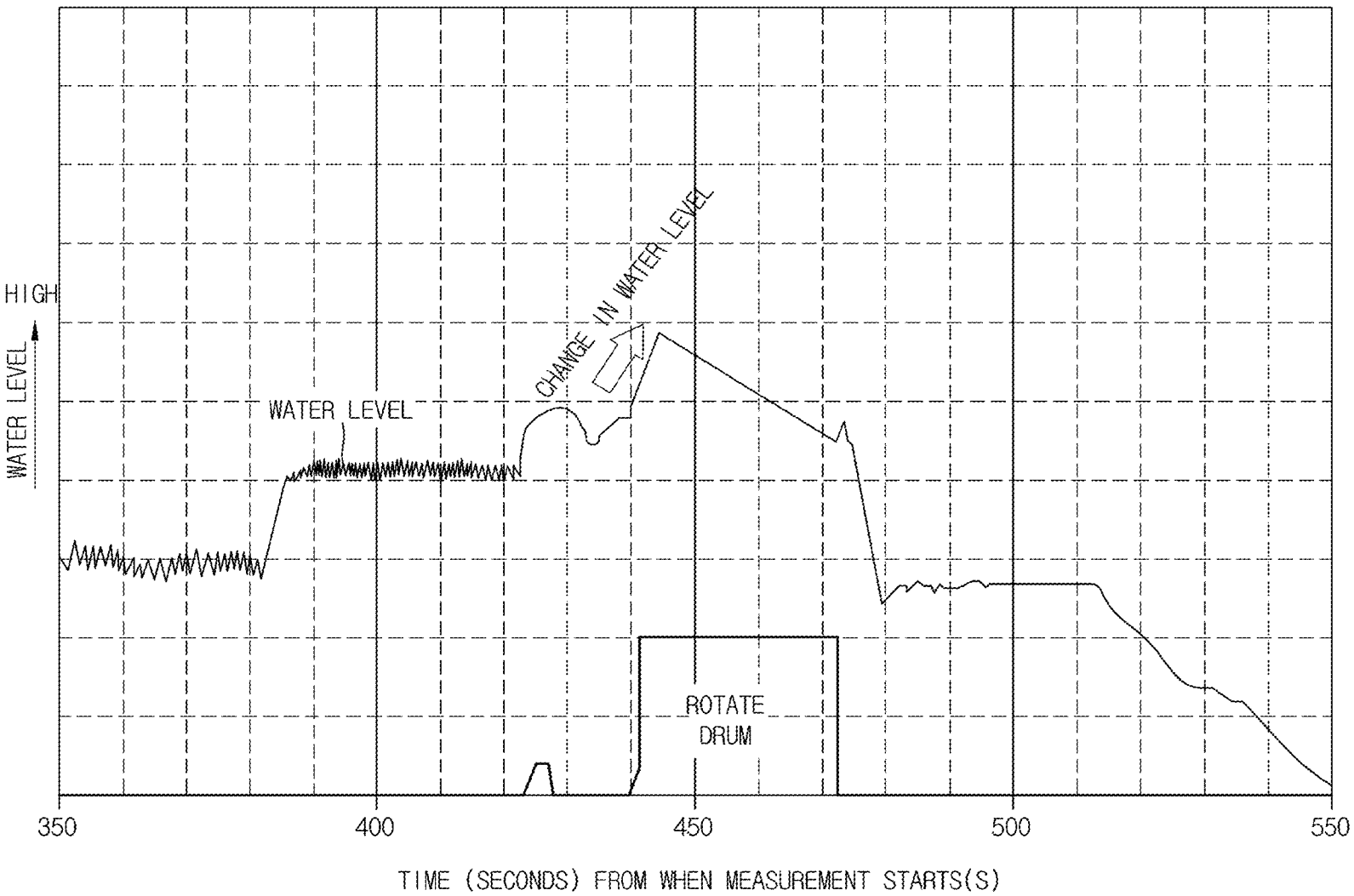
FIG. 11 shows an example of changes in water level of water between the tub and the drum before and after the drum rotates in the case in which all laundry is water-permeating laundry.
Figure 12:
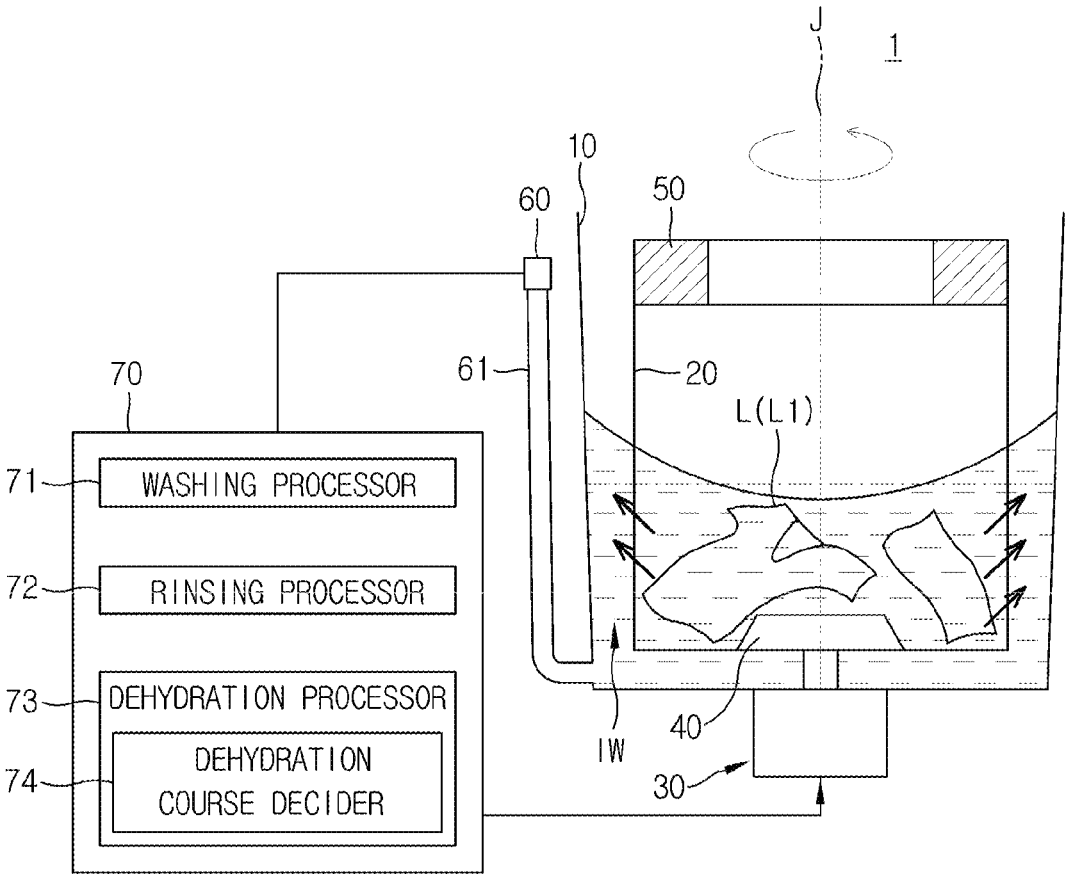
FIG. 12 is a view briefly showing a state when the drum rotates in the case in which all laundry is water-permeating laundry.
Figure 13:
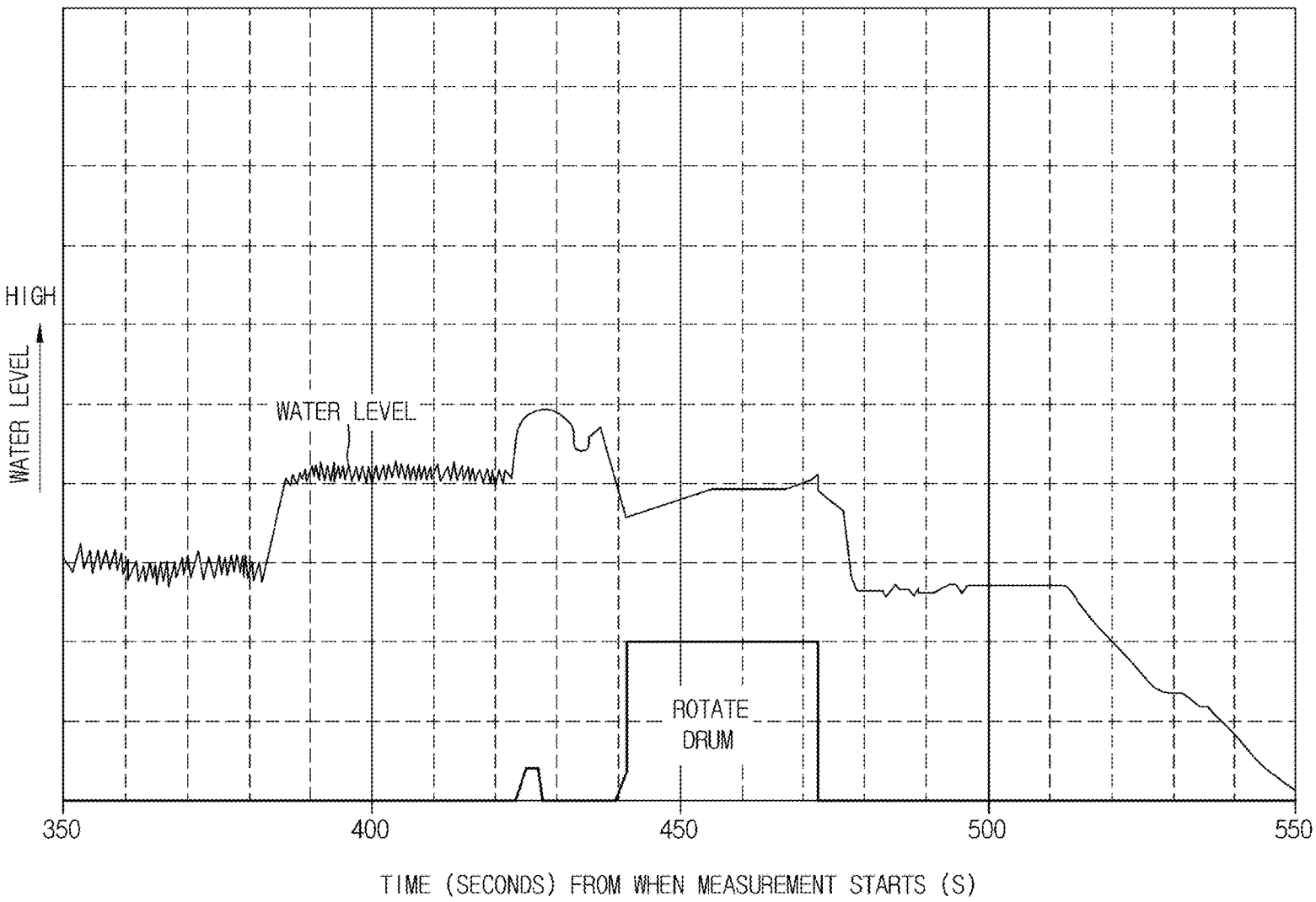
FIG. 13 shows an example of changes in water level of water between the tub and the drum before and after the drum rotates in the case in which laundry includes waterproof laundry.
Figure 14:
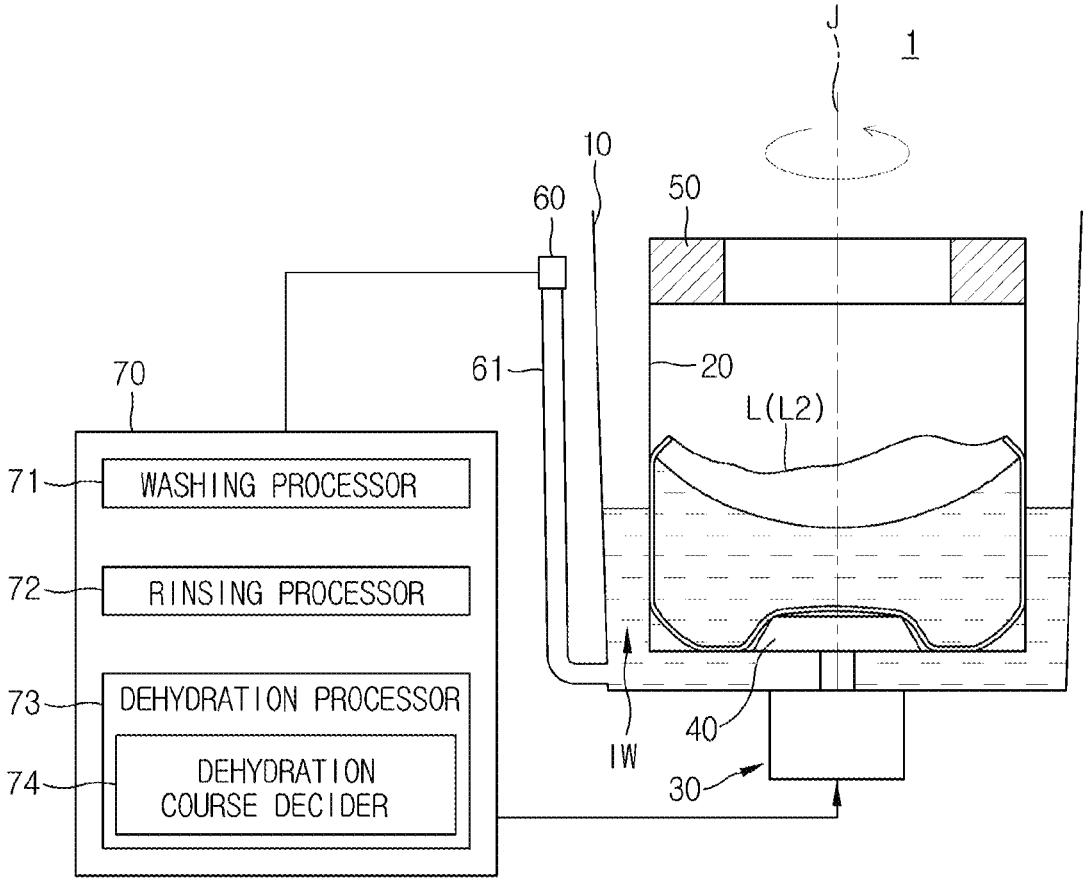
FIG. 14 is a view briefly showing a state when the drum rotates in the case in which laundry includes waterproof laundry.
Figure 15:
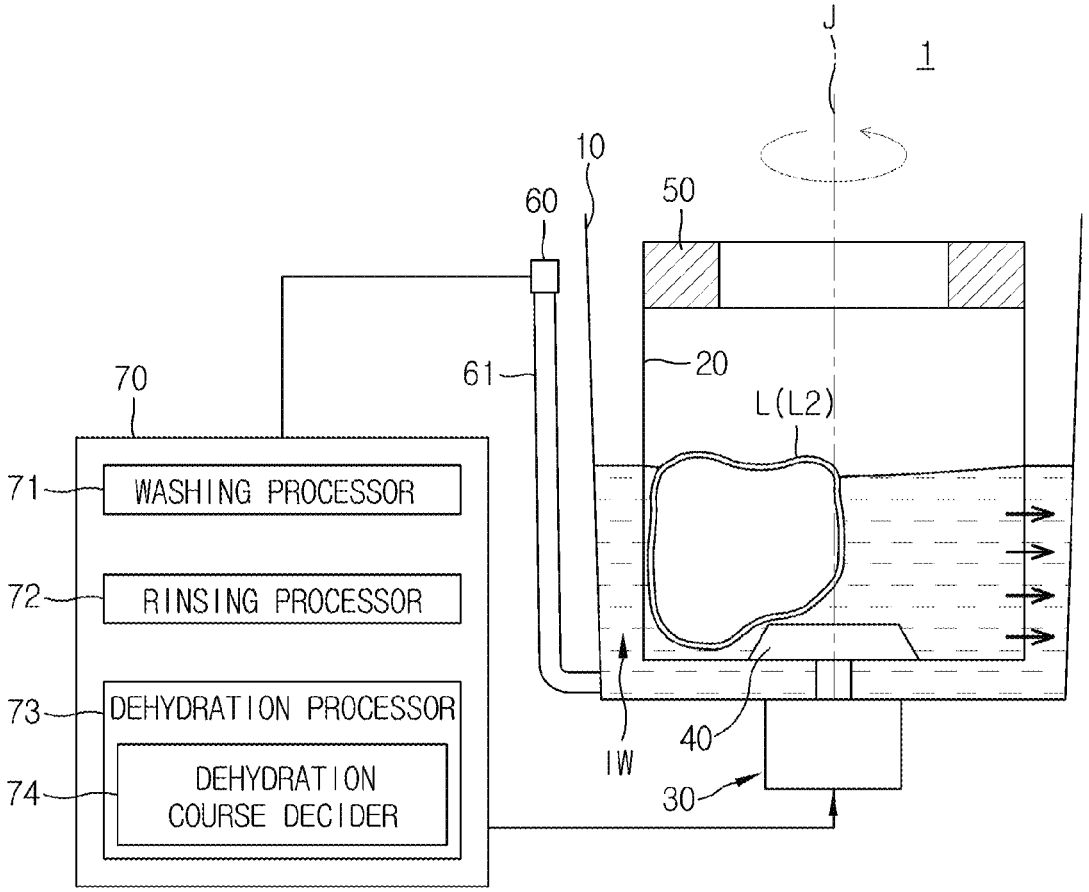
FIG. 15 is a view briefly showing a state when the drum rotates in the case in which laundry includes waterproof laundry.

FIG. 11 shows an example of changes in water level of water between the tub and the drum before and after the drum rotates in the case in which all laundry is water-permeating laundry, FIG. 12 is a view briefly showing a state when the drum rotates in the case in which all laundry is water-permeating laundry, FIG. 13 shows an example of changes in water level of water between the tub and the drum before and after the drum rotates in the case in which laundry includes waterproof laundry, FIG. 14 is a view briefly showing a state when the drum rotates in the case in which laundry includes waterproof laundry, and FIG. 15 is a view briefly showing a state when the drum rotates in the case in which laundry includes waterproof laundry.

FIG. 11 shows an example of changes in water level of water IW collected between the tub 10 and the drum 20 in the case in which all laundry L is water-permeating laundry L1. Water-level changes until about 60 seconds before the drum 20 starts rotating may be caused by the influence of a water current in a rinsing process, and after that time, a water level may rise by the influence of a tangling prevention process.

As shown in FIG. 12, if the drum 20 rotates, water in the inside of the drum 20 may be discharged from the drum 20 without resistance by the influence of a centrifugal force if all laundry L is water-permeating laundry L1. Accordingly, a water level of water IW collected between the tub 10 and the drum 20 may rise greatly, as denoted by a thick arrow in FIG. 11, so that a second water-level difference ΔW2 becomes a great value.

FIG. 13 shows an example of changes in water level of water IW collected between the tub 10 and the drum 20 in the case in which laundry L includes waterproof laundry L2. For example, when waterproof laundry L2 is gathered on the wall of the drum 20, as shown in FIG. 14, the waterproof laundry L2 may prevent water from being discharged from the inside of the drum 20. Accordingly, a water level of the water IW collected between the tub 10 and the drum 20 may not rise greatly although a centrifugal force acts, as shown in FIG. 14, so that a second water-level difference ΔW2 becomes a small value.

Also, if waterproof laundry L2 is filled with water, as shown in FIG. 15, the water filled in the waterproof laundry L2 cannot move freely in the state in which the waterproof laundry L2 is gathered and fixed on the side wall by the action of a centrifugal force, so as not to contribute to a change in water level. Accordingly, in this case, a water level of water IW collected between the tub 10 and the drum 20 may not rise greatly, so that a second water-level difference ΔW2 becomes a small value.

As such, a second water-level difference ΔW2 measured when all laundry L is water-permeating laundry L2 may be greater than a second water-level difference ΔW2 measured when laundry L includes waterproof laundry L2. Accordingly, in the current example, the second reference value may be set to 13 mm to detect a state of abnormal water remaining.

If the dehydration course decider 74 determines that the second water-level difference ΔW2 is smaller than the second reference value, a low-speed dehydration course may be selected so that a low-speed dehydration process is performed, like the first embodiment, in operation S8. After the dehydration process is completed, a notification may be sent to a user, in operation S9.

Also, if the dehydration course decider 74 determines that the second water-level difference ΔW2 is greater than or equal to the second reference value, a high-speed dehydration course may be selected, like the first embodiment, so that a normal dehydration process may be performed, in operation S10.

Third Embodiment (Configuration of the Washing Machine)

A configuration of a washing machine 1 according to a third embodiment of the present disclosure may be the same as that of the washing machine 1 according to the first embodiment. Accordingly, the same components as those of the washing machine 1 according to the first embodiment will be assigned the same reference numerals, and detailed descriptions thereof will be omitted.

The washing machine 1 may decide a dehydration course, based on a change in water level of water IW collected between the tub 10 and the drum 20 by driving of the circulation pump 80, and a change in water level of water IW collected between the tub 10 and the drum 20 by rotating the drum 20 at low speed.

Figure 16:
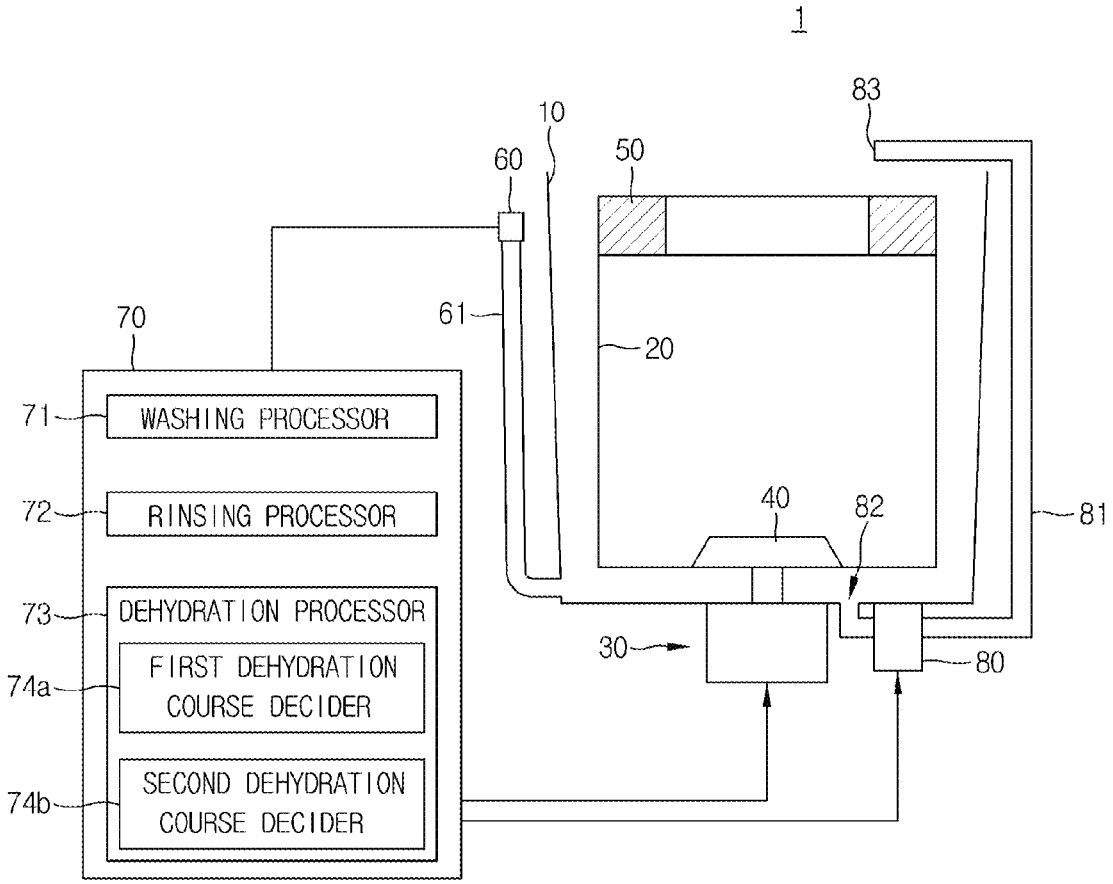
FIG. 16 is a view briefly showing a main portion of the washing machine according to the third embodiment.

That is, the dehydration course decider 74 of the washing machine 1 may include, as shown in FIG. 16, a first dehydration course decider 74*a* corresponding to the dehydration course decider 74 of the washing machine 1 according to the first embodiment, and a second dehydration course decider 74*b* corresponding to the dehydration course decider 74 of the washing machine 1 according to the second embodiment. The dehydration course decider 74 may control the first dehydration course decider 74*a* and the second dehydration course decider 74*b* in combination to perform a dehydration course deciding process. The operation of the washing machine 1 will be described with reference to FIGS. 16 and 17, below.

(Operation of the Washing Machine)

Figure 17:
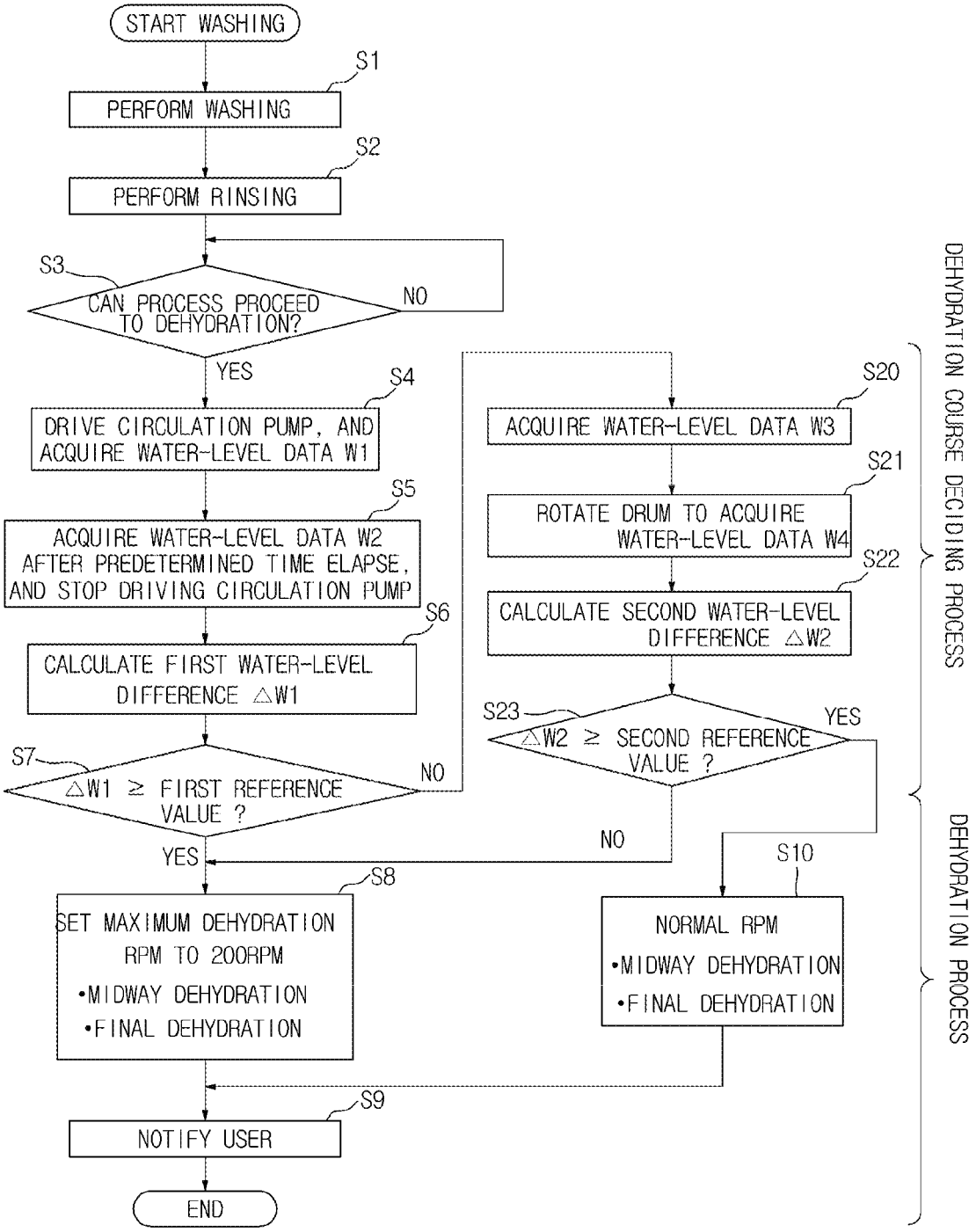
FIG. 17 is a flowchart showing operations of the washing machine according to the third embodiment.

FIG. 16 is a view briefly showing a main portion of the washing machine according to the third embodiment, and FIG. 17 is a flowchart showing operations of the washing machine according to the third embodiment.

In FIG. 17, a washing process and a rinsing process may be the same as the corresponding ones of the first embodiment. That is, a user may put laundry L and a detergent, and manipulate a switch to operate the washing machine 1. Thereby, a washing process may be performed by the control of the washing processor 71, in operation S1, and then, a rinsing process may be performed by the control of the rinsing processor 72, in operation S2. During the washing process or the rinsing process, the circulation pump 80 may be driven for a predetermined time period so as to circulate water in the inside of the tub 10.

The rinsing processor 72 may determine whether the process can proceed to a dehydration process, in operation S3, and if the rinsing process terminates so that a dehydration process can be performed, the first dehydration course decider 74*a* may perform a first dehydration course deciding process of deciding a dehydration course, together with a tangling prevention process ("YES" in operation S3). The first dehydration course deciding process may be the same as the dehydration course deciding process of the washing machine 1 according to the first embodiment.

That is, the circulation pump 80 may be driven, and the water-level sensor 60 may measure reference water-level data (W1: first water level) just after the circulation pump 80 starts operating, in operation S4. Thereafter, when the circulation pump 80 operates, the water-level sensor 60 may measure comparative water-level data (W2: second water level), and if the measurement terminates, the circulating pump 80 may stop, in operation S5.

The first dehydration course decider 74*a* may calculate a first water-level difference (ΔW1=W2−W1) using the first and second water-level data received from the water-level sensor 60, in operation S6, and may determine whether the first water-level difference ΔW1 is greater than or equal to a first reference value (for example, 60 mm), in operation S7.

If the first dehydration course decider 74*a* determines that the first water-level difference ΔW1 is greater than or equal to the first reference value, the first dehydration course decider 74*a* may select a low-speed dehydration course after a drainage process is performed so that a dehydration process is performed at low speed, in operation S8. After the dehydration process is completed, a notification may be sent to the user, in operation S9.

Meanwhile, if the first dehydration course decider 74 determines that the first water-level difference ΔW1 is smaller than the first reference value, the second dehydration course decider 74*b* may perform a second dehydration course deciding process together with a tangling prevention process. The second dehydration course deciding process may be the same as the dehydration course deciding process of the washing machine 1 according to the second embodiment.

That is, the water-level sensor 60 may measure reference water-level data (W3: third water level), then the drum 20 may rotate at low RPM for water-level detection, and while the drum 20 rotates, the water-level sensor 60 may measure comparative water-level data (W4: fourth water level), in operations S20 and S21. If the measurement terminates, the drum 20 or the pulsator 40 may stop rotating, and a drainage process may be performed.

The second dehydration course decider 74*b* may calculate a second water-level difference (ΔW2=W4−W3) using the third and fourth water-level data, and determine whether the second water-level difference ΔW2 is greater than or equal to a second reference value (for example, 13 mm), in operations S22 and S23.

If the second dehydration course decider 74*b* determines that the second water-level difference ΔW2 is smaller than the second reference value, a low-speed dehydration process may be performed, or a notification may be sent to the user, in operations S8 and S9.

If the second dehydration course decider 74*b* determines that the second water-level difference ΔW2 is greater than or equal to the second reference value, a high-speed dehydration course may be selected so that a normal dehydration process is performed, in operation S10.

As such, by combining changes in water level detected at different times although the same change in water level is detected, the accuracy of detection can be greatly improved. Accordingly, the washing machine 1 according to the third embodiment can more appropriately deal with a case in which laundry L includes waterproof laundry L2.

Also, the washing machine according to the present disclosure is not limited to the above-described embodiments, and may include various configurations.

The water-level sensor 60 is an example, and a detection method is not limited. For example, a sensor for detecting a water level through a change in oscillation frequency according to pressure, or a sensor for measuring a distance to the surface of liquid in a non-contact manner through sound waves may be used.

When a dehydration process is performed several times, a dehydration course deciding process may be preferably performed for each dehydration process. Although a change in water level is measured for a unit time, instead that a water-level difference is calculated at predetermined time intervals, the substantially same effect can be obtained.

A dehydration stop course, as well as a low-speed dehydration course and a high-speed dehydration course, may be selected according to a degree of change in water level. The absolute value of a water-level difference may be compared to a reference value, and also, a positive (+) or negative (−) value of a water-level difference may be compared to the reference value.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A washing machine comprising:

a tub configured to accommodate water;

a drum rotatably installed in the inside of the tub, and having a side wall to pass water through, the drum including a stirring apparatus configured to stir water collected in the inside of the drum;

a water-level sensor configured to detect a water level of water collected between the tub and the drum;

a circulation pump configured to circulate water collected in the inside of the tub, and to supply the water to the inside of the drum; and at least one processor configured to:

drive the circulation pump for a predetermined time period when the stirring apparatus stops, measure a first water level collected between the tub and the drum with the water-level sensor when the circulation pump starts being driven, stop the circulation pump after the predetermined time period elapses, measure a second water level collected between the tub and the drum with the water-level sensor after the circulation pump stops, calculate a difference in water level between the first water level and second water level, compare the calculated difference to a predetermined reference value, and control a dehydration course based on the comparison.

2. A washing machine comprising:

a tub configured to accommodate water;

a drum rotatably installed in the inside of the tub and having a side wall to pass water through, the drum including a stirring apparatus configured to stir water collected in the inside of the drum;

a water-level sensor configured to detect a water level of water collected between the tub and the drum;

a circulation pump configured to circulate water collected in the inside of the tub, and to supply the water to the inside of the drum; and at least one processor configured to:

drive the circulation pump for a predetermined time period when the stirring apparatus is driven, measure a first water level collected between the tub and the drum with the water-level sensor when the circulation pump starts being driven, stop the circulation pump after the predetermined time period elapses, measure a second water level collected between the tub and the drum with the water-level sensor after the circulation pump stops, calculate a difference in water level between the first water level and second water level, compare the calculated difference to a predetermined reference value, and control a dehydration course based on the comparison.

3. The washing machine according to claim 1, wherein the at least one processor is further configured to limit a dehydration RPM based on a result of the comparison to perform the dehydration course.

4. The washing machine according to claim 3, wherein the at least one processor is further configured to inform a user of progress of the dehydration course based on the result of the comparison.

5. The washing machine according to claim 1, wherein the at least one processor is further configured to perform the dehydration course without limiting a dehydration RPM based on a result of the comparison.

6. A method of controlling a washing machine, the washing machine including a tub configured to accommodate water, a drum rotatably installed in the inside of the tub and having a side wall to pass water through, a water-level sensor configured to detect a water level of water collected between the tub and the drum, and a circulation pump configured to circulate water collected in the inside of the tub and to supply the water to the inside of the drum, the method comprising:

determining whether a dehydration course starts;

driving, if it is determined that the dehydration course starts, the circulation pump, measuring a first water level of water collected between the tub and the drum when the circulation pump starts being driven;

counting a time after the circulation pump is driven to determine whether a predetermined time period elapses;

stopping, if it is determined that the predetermined time period elapses, the circulation pump;

measuring a second water level of water collected between the tub and the drum when the circulation pump stops;

calculating a difference in water level between the first water level and the second water level;

comparing the difference in water level to a predetermined reference value; and controlling a dehydration RPM based on a result of the comparison to perform the dehydration course.

7. The method according to claim 6, wherein the performing of the dehydration course comprises limiting the dehydration RPM if the difference in water level is greater than or equal to the predetermined reference value to perform the dehydration course.

8. A method of controlling a washing machine, the washing machine including a tub configured to accommodate water, a drum rotatably installed in the inside of the tub and having a side wall to pass water through, a driving apparatus configured to rotate the drum, a water-level sensor configured to detect a water level of water collected between the tub and the drum, and a circulation pump configured to circulate water collected in the inside of the tub and to supply the water to the inside of the drum, the method comprising:

determining whether a dehydration course starts;

driving the circulation pump, if it is determined that a dehydration course starts, measuring a first water level of water collected between the tub and the drum when the circulation pump starts being driven;

stopping the circulation pump, if a predetermined time period elapses after the circulation pump is driven;

measuring a second water level of water collected between the tub and the drum when the circulation pump stops;

calculating a first difference in water level between the first water level and the second water level;

comparing the first difference in water level to a predetermined first reference value;

if the first difference in water level is smaller than the predetermined first reference value, measuring a third water level of water collected between the tub and the drum;

rotating the drum in a state in which water is collected in the tub;

measuring a fourth water level of water collected between the tub and the drum;

calculating a second difference in water level between the third water level and the fourth water level;

comparing the second difference in water level to a predetermined second reference value; and controlling a dehydration RPM based on a result of the comparison to perform the dehydration course.

9. The method according to claim 8, wherein the performing of the dehydration course further comprises:

if the first difference in water level is greater than or equal to the predetermined first reference value, limiting the dehydration RPM to perform the dehydration course; and if the second difference in water level is greater than or equal to the predetermined second reference value, limiting the dehydration RPM to perform the dehydration course.

* * * * *